US005979291A

United States Patent [19]

Juvonen

[11] Patent Number: 5,979,291

[45] Date of Patent: Nov. 9, 1999

[54] HYDRAULICALLY OPERATED PERCUSSION HAMMER

[75] Inventor: Esko Juvonen, Lahti, Finland

[73] Assignee: Tamrock Oy, Finland

[21] Appl. No.: 08/893,369

[22] Filed: Jul. 15, 1997

[30] Foreign Application Priority Data

Jul. 19, 1996 [FI] Finland ..... 962911

[51] Int. Cl.[6] ..... F01L 15/00; F01L 21/02; F01B 7/18

[52] U.S. Cl. ..... 91/239; 91/243; 91/321; 91/274

[58] Field of Search ..... 91/235, 236, 239, 91/240, 243, 244, 321, 274

[56] References Cited

U.S. PATENT DOCUMENTS

| | | | |
|---|---|---|---|
| 3,774,502 | 11/1973 | Arndt | 91/321 X |
| 3,965,799 | 6/1976 | Juvonen et al. | 91/321 X |
| 4,020,746 | 5/1977 | Arndt | 91/321 X |
| 4,291,771 | 9/1981 | Perraud | 173/106 |
| 4,800,797 | 1/1989 | Comarmond | 91/321 X |
| 4,899,836 | 2/1990 | Venot . | |

FOREIGN PATENT DOCUMENTS

| | | |
|---|---|---|
| 86762 | 6/1992 | Finland . |
| 92477 | 8/1994 | Finland . |
| 0 715 932 A1 | 6/1996 | France . |
| 1 960 706 | 8/1971 | Germany . |
| 29 12 426 A1 | 10/1979 | Germany . |
| 195 07 348 A1 | 9/1996 | Germany . |
| 7900897-5 | 2/1985 | Sweden . |

*Primary Examiner*—John E. Ryznic
*Attorney, Agent, or Firm*—Nixon & Vanderhye P.C.

[57] ABSTRACT

A hydraulically operated percussion hammer comprising a percussion piston that reciprocates by means of the pressure of the pressure fluid, a main valve that is controlled by the position of the percussion piston and that guides the pressure fluid to the percussion piston in order to provide a reciprocating motion, and a pressure control valve that is placed in an outlet duct for pressure fluid and that prevents the flow of the pressure fluid from the percussion apparatus before the pressure of the pressure fluid in the inlet duct exceeds the set value of the pressure control valve. The percussion apparatus comprises a separate by-pass duct which allows the pressure fluid to flow from the pressure chamber of the percussion piston past the pressure control valve to the outlet duct until the percussion piston has reached a certain point during its return motion.

5 Claims, 3 Drawing Sheets

HYDRAULICALLY OPERATED PERCUSSION HAMMER

Figure 1:
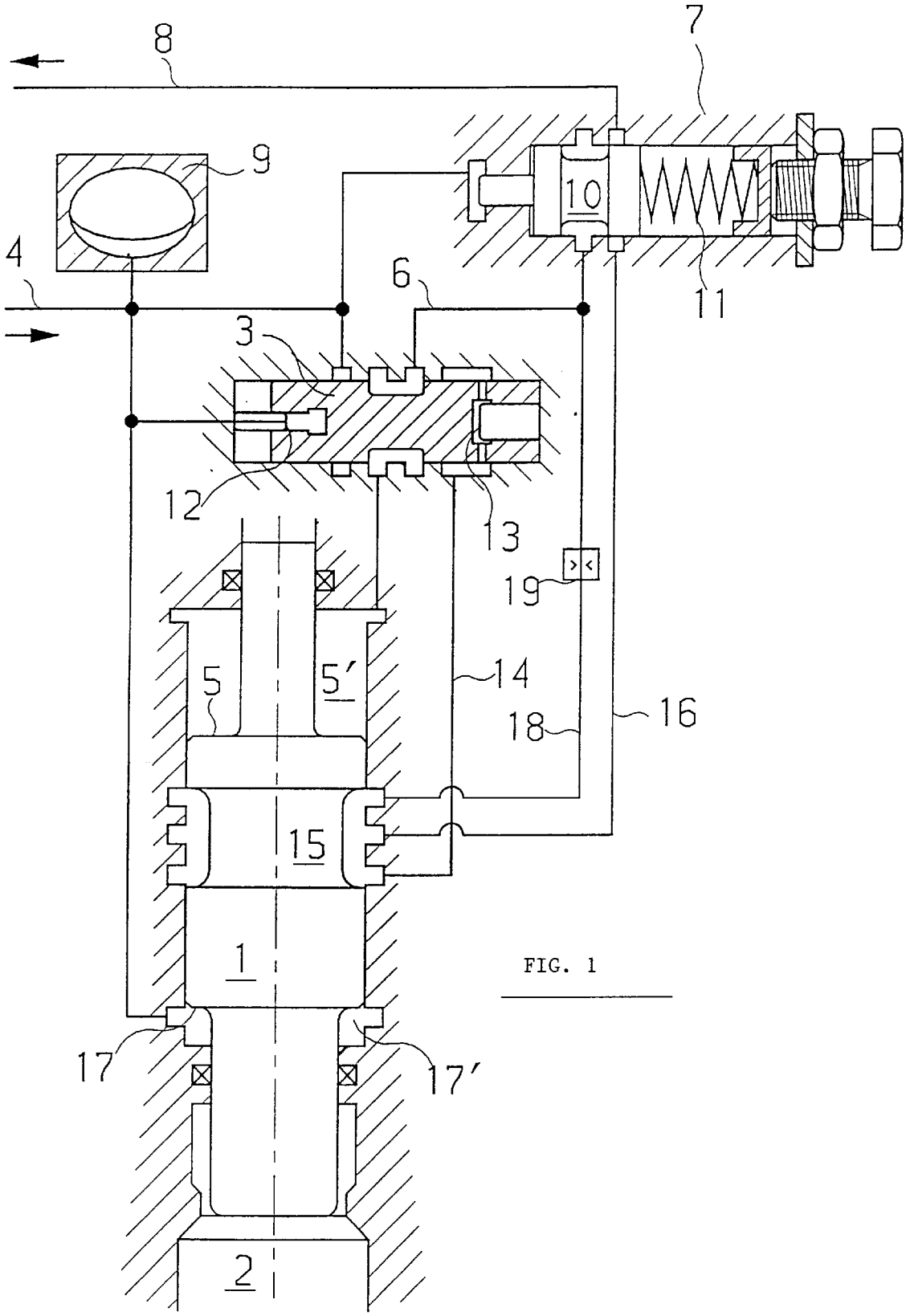

The invention relates to a hydraulically operated percussion hammer comprising a reciprocating percussion piston, ducts for supplying pressure fluid to the percussion hammer and for removing it therefrom, a main valve connected to be controlled by the position of the percussion piston so that it controls the flow of the pressure fluid to pressure surfaces of the percussion piston in order to provide a reciprocating motion, and a pressure control valve that is placed in the outlet duct and that is connected to the inlet duct for pressure fluid so that it opens the flow of pressure fluid from the percussion hammer to the outlet duct only when the pressure of the pressure fluid in the inlet duct exceeds a predetermined set value for pressure.

Percussion hammers are generally used for breaking relatively hard materials, such as rock, concrete, asphalt, frozen soil, metallurgical slag or the like. When a percussion hammer and its tool are pressed against the material to be broken, the percussion piston strikes the top of the tool at high velocity, so that at the lower end of the tool the material to be broken is subjected to such a great force effect that it breaks or the tool penetrates the material. In such apparatuses, the high velocity of the percussion piston is usually generated hydraulically and by means of a pressure accumulator connected to the percussion hammer. The pressure accumulator usually contains an amount of nitrogen gas in an enclosed space and it is usually connected to pressure fluid ducts where it receives pressure fluid during the slow return motion of the percussion piston and releases the fluid during the rapid motion in the impact direction.

The pressure fluid acts on the percussion piston via usually shoulder-shaped pressure surfaces in such a way that for the purpose of acceleration in the impact direction, the force that is formed of the sum of the pressures and the product of the areas of the pressure surfaces is great in order to provide a high velocity of the percussion piston for the impact, whereas the force is as small as possible in the return direction so that the power losses of the percussion hammer would remain small and the efficiency would be high. For this reason, it is necessary to provide at least two pressure surfaces that act in opposite directions so that the force moving the percussion piston can be directed alternately in the impact direction and in the return direction.

Percussion hammers are usually installed as auxiliary equipment to excavators to replace the bucket, but other base machines and mounts can also be used. Percussion hammers therefore operate with the hydraulics of the base machine in such a way that a high-pressure hydraulic fluid arrives from the base machine to the percussion hammer via the start valve of the percussion hammer along inlet pipes and it is discharged in a low pressure form along return pipes to the container of the base machine. The breaking capacity and the so-called output power of hydraulically operated percussion hammers primarily depend on the impact energy and stroke frequency of the percussion piston, but also on the properties of the material to be broken and the shape of the tool, and on the operation force, which refers to the force with which the entire percussion hammer is pressed against the tool and the material to be broken.

In order that a percussion hammer could be used advantageously in as many different breaking operations as possible and in different excavators or other base machines, percussion hammers are usually provided with pressure control devices. Percussion hammers are usually designed to operate preferably with such a maximum value of volume flow that is suitable for the most common excavators of a desired size group. When a percussion hammer is used with a volume flow that is smaller than planned, neither the desired working pressure nor the desired impact energy are achieved. The pressure control devices are used to raise the working pressure to the desired level when it would otherwise remain low due to the small volume flow. The pressure control devices are required in the percussion hammer also in connection with the start-up and stop to prevent the percussion hammer from operating when the pressure accumulator does not contain a sufficient amount of fluid for an impact, in which case the accumulator is in danger of being damaged and cavitation may occur in the pressure fluid ducts. By means of such a pressure control valve it is possible, in connection with stopping the percussion hammer, to enclose the pressure preferably inside the percussion hammer and also the desired liquid volume inside the pressure accumulator to expedite the restarting of the percussion hammer, which is important for example during the breaking of loose rock.

A disadvantage of such control systems is the variation caused by the properties of the material to be broken in the operation of the percussion hammer. When the object of percussion is a hard material, some of the impact energy is reflected as a rebound or a return pulse back to the percussion piston, providing the piston with great initial velocity in the return direction. When the object of percussion is a soft material, almost all the energy may be used to enable the tool to penetrate the material to be broken, so that the rebound is zero and the percussion piston is provided with no initial velocity in the return direction.

Most of the rebound energy generated by a hard rock can be stored back in the inlet side of pressure fluid or in the pressure accumulator if the force that acts on the percussion piston after the rebound is maintained in the impact direction and the pressure surface accelerating in the impact direction is not connected directly to the return ducts. This is achieved by timing the main valve of the percussion hammer such that the percussion piston can move a relatively long portion of its stroke length in the return direction before the outlet of the pressure fluid to the return line is opened. Such an energy recovery system improves the efficiency of the percussion hammer and increases the stroke frequency of the hammer.

The present invention relates to a hydraulically operated percussion hammer comprising a pressure control valve placed in a return duct such that during the return motion of the percussion piston the return flow is prevented when the pressure fluid in the inlet duct is below a set value, so that the return motion of the percussion piston stops and the piston does not reach its uppermost position from which it could switch back to a motion in the impact direction. When the pressure exceeds the predetermined value, the pressure control valve opens steplessly and allows the return flow and the return motion of the percussion piston. If the main valve of the percussion hammer is timed such that when the object of impact is a hard material the majority of the rebound energy can be returned to the high pressure side of the hydraulics, the return flow operates in known arrangements in a pulse-like manner with small volume flows, causing thus problems in the piping of the percussion hammer and in the durability of hose couplings. Since such a pressure control valve prevents the return flow of the percussion piston immediately after the rebound with small volume flows, the impulse of the return flow is the greater the smaller the volume flow with which the percussion hammer operates.

The purpose of the present invention is to provide a percussion hammer that avoids the problems of the prior art and that provides reliable operation of the percussion hammer both with great and small volume flows and hard and soft materials. The percussion hammer according to the invention is characterized in that the percussion hammer comprises a separate by-pass duct via which the pressure fluid may flow during the return motion of the percussion piston from a pressure space situated above the percussion piston to the outlet duct to a certain point in the return motion of the percussion piston even when the pressure of the pressure fluid in the inlet duct is smaller than said set value of the pressure control valve.

The basic idea of the invention is that the percussion hammer comprises a separate by-pass duct via which pressure fluid can flow slowly from behind the percussion piston so that a slow return motion of the piston is possible even when the pressure of the pressure fluid in the inlet duct does not exceed the predetermined set value necessary for operation. Further, the idea of a preferred embodiment of the invention is that the by-pass duct is connected to be controlled by the percussion piston so that the by-pass duct is only open during a certain length of the return motion of the piston, whereafter as the percussion piston arrives at the aforementioned point, the by-pass duct is closed and the percussion piston stops at this point unless the pressure in the inlet duct has reached the set value. The percussion hammer according to the invention has the advantage that the percussion piston also moves in the return direction during the breaking of a soft material, even if this movement is slow, until the pressure in the inlet duct exceeds the predetermined set value. In such a case, the pressure pulses that are generated in the ducts remain smaller than previously and the capacity of the apparatus is improved while its operation becomes more reliable. On the other hand, if the pressure of the pressure fluid in the inlet duct already exceeds the set value after the rebound, the pressure fluid can flow normally via the pressure control valve and the impact operation continues normally.

Figure 2:
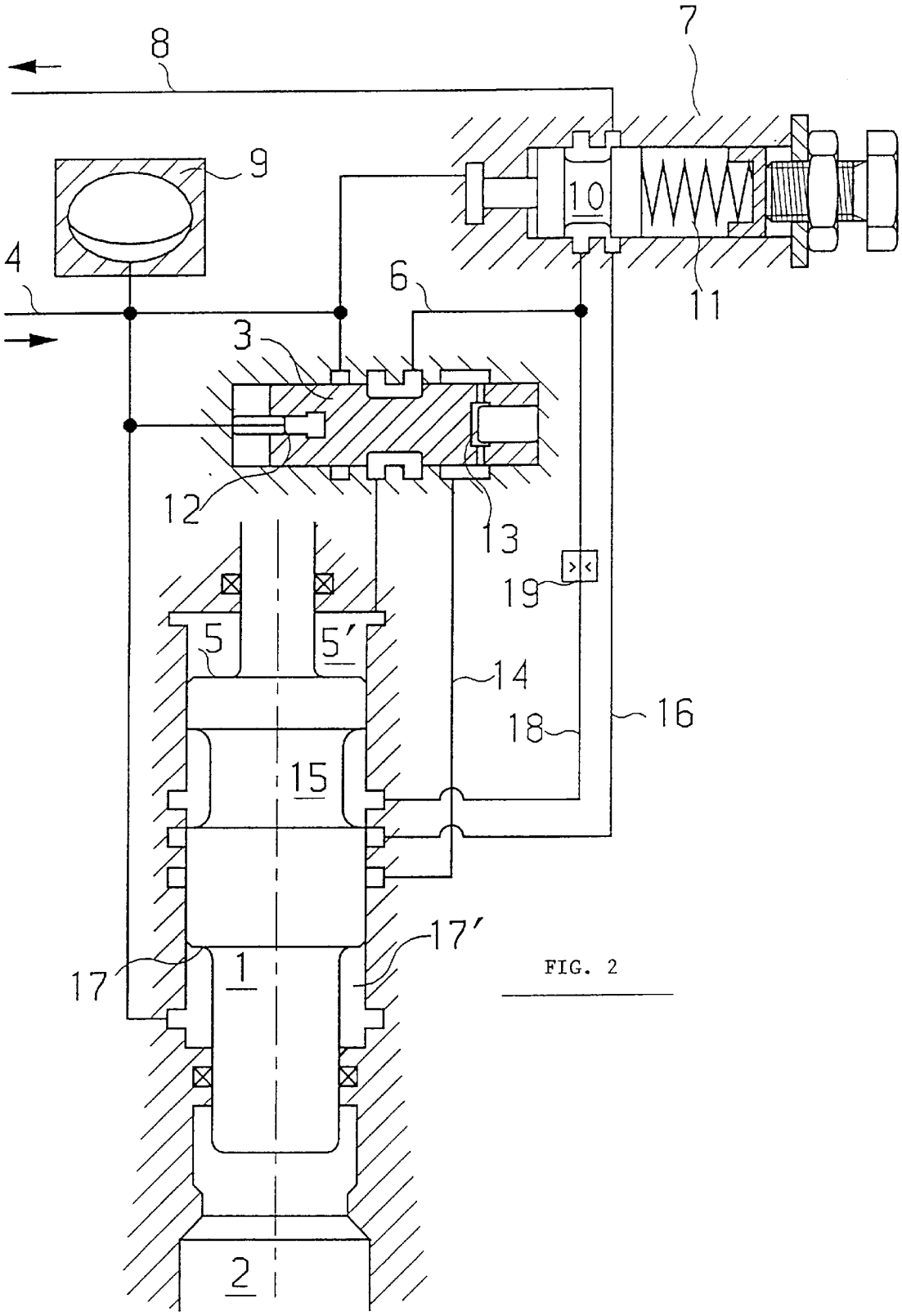
Figure 3:
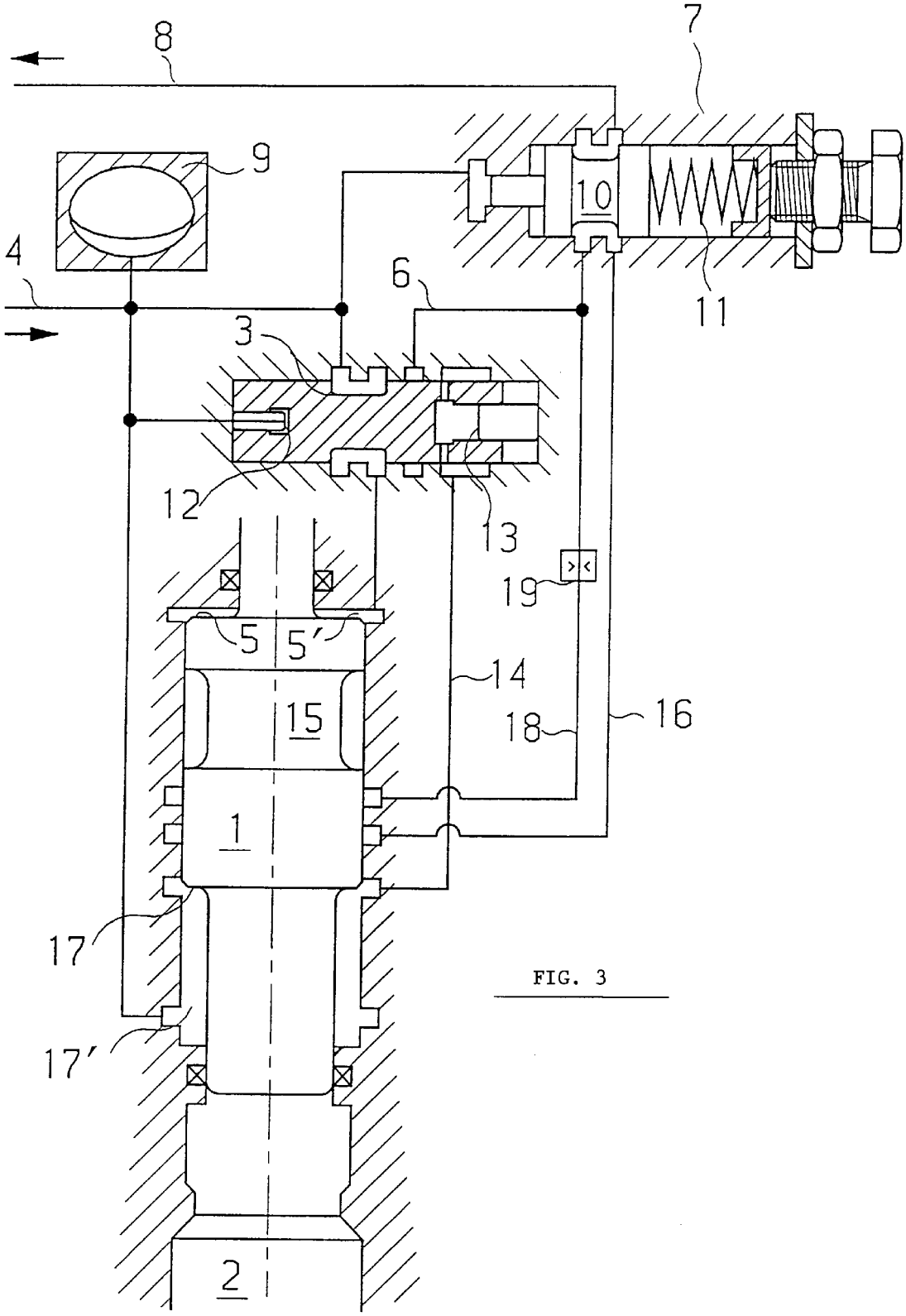

The invention will be described in greater detail in the accompanying drawings, in which FIG. 1 shows schematically a percussion hammer according to the invention at the end of an impact, FIG. 2 shows schematically a percussion hammer according to the invention at a certain stage of the return motion of the percussion piston, and FIG. 3 shows schematically a percussion hammer according to the invention in the farthest position of the percussion piston at the beginning of an impact.

FIG. 1 shows schematically a percussion hammer according to the invention in a situation where the percussion piston has performed an impact motion and is about to start a return motion. In the figure, the percussion piston 1 is in the impact position against a tool 2. A main valve 3 has just closed the connection from an inlet duct 4 to a pressure space 5' of variable pressure above the percussion piston and to a pressure surface 5 of the percussion piston and it has simultaneously opened a connection along a duct 6 to a pressure control valve 7 that may further open a connection from the duct 6 to a return duct 8 by means of the high pressure in the inlet duct 4. The pressure control valve 7 operates in a known manner such that when the pressure increases in a pressure accumulator 9 connected to the inlet duct 4, a spindle 10 moves continuously against a spring 11 so that a connection is opened from the duct 6 to the return duct 8.

The main valve 3 changes from one position to another in a known manner controlled by the position of the percussion piston 1. The main valve 3 is moved to the position shown in FIG. 1 by a smaller pressure surface 12 that is always connected to the inlet duct 4, and it is moved to the position shown in FIG. 3 and described in relation thereto by a greater pressure surface 13 that is connected in the impact position of the piston to the return duct 8 via a duct 14, a groove 15 of the percussion piston and a duct 16. In the upper position of the percussion piston 1, a high-pressure connection is opened from a pressure space 17' below the piston via the duct 14 to the greater pressure surface 13 of the main valve 3 in the manner shown in FIG. 3, so that a high-pressure connection is opened from the inlet duct 4 to the pressure surface 5 above the percussion piston, and the piston 1 starts a movement in the impact direction. The pressure space 17' comprises an annular pressure surface 17 that is oriented to the return direction from the percussion piston 1 and that is smaller than the upper pressure surface 5. When a high pressure prevails in the pressure space 5' of the pressure surface 5, a force that acts on the percussion piston in the impact direction is generated, and when the pressure space 5' is connected to the return duct 8, a force acting on the percussion piston in the return direction is generated.

According to the present invention, a by-pass duct 18 is arranged to pass the pressure control valve 7 and it is open via the groove 15 of the percussion piston 1 when the piston 1 is in the position on the side of the tool 2 on its path, and it is closed when the percussion piston 1 comes close to the uppermost position in its return motion. When the object of impact is a soft material and the volume flows are small, the rebound of the percussion piston 1 remains small and the piston tries to move in the return direction almost only by the action of the force acting on the pressure surface 17. When the volume flow is small, more pressure fluid has been discharged from the pressure accumulator 9 during the impact motion than with great volume flows, and the pressure in the inlet duct 4 has dropped so low that the pressure control valve 7 has closed the connection from the duct 6 to the return duct 8. Conventional percussion hammers operate such that the percussion piston stops to wait for the opening of the pressure control valve 7, but in the apparatus according to the present invention the percussion piston moves slowly in the return direction as the pressure fluid flows from the pressure space 5' via the main valve 3, the ducts 6 and 18, and the groove 15 to the duct 16 and from there to the return duct 8. The motion of the percussion piston is adjusted with a throttle 19 provided in the by-pass duct 18 to correspond to an advantageous return velocity when the percussion hammer operates with the minimum volume flow.

With great volume flows, the pressure fluid flows to the return duct 8 simultaneously via the by-pass duct 18 and the pressure control valve 7. When the object of impact if a soft material, the working pressure would become high in known percussion hammers since the percussion piston would be forced to move almost the entire distance of the stroke length in the return direction after the pressure control valve 7 has opened, but in the apparatus according to the present invention the percussion piston 1 has at this stage moved a long distance in the return direction. When the object of impact is a hard material, the percussion piston 1 first rebounds at high velocity and it would therefore create a great impulse in the return duct 8 and further in the pipes of the excavator or some other base machine. With small volume flows, the percussion piston would first have to wait for the increase of pressure in the high pressure side and it would therefore cause a great impulse in the return duct 8. In the percussion hammer according to the present invention, pressure fluid is discharged from the pressure space 5' via the by-pass duct 18 and the groove 15 of the percussion piston, so that no great pressure pulse is generated in the return duct 8 and the return pipes. According to the invention, the percussion piston 1 closes the by-pass duct 18 when it has gone up a desired distance in the return direction, which is shown in FIG. 2. If the pressure in the inlet duct 4 is so low that the pressure control valve 7 is not yet open, as for example when the percussion hammer is started or stopped, the percussion piston 1 stops in the position shown in FIG. 2.

It is natural that the apparatus according to the invention can be varied with conventional means, for example as regards the control of the main valve of the percussion piston, in which case it may also be provided with for example adjustment of the stroke length as disclosed in Finnish Patent Application 953,337. The apparatus according to the invention may also be implemented such that the pressure accumulator is placed in connection with the percussion piston instead of or in addition to the inlet duct to act on the percussion piston in a spring-like manner and to increase the force that accelerates the percussion piston in the impact direction.

I claim:

1. A hydraulically operated percussion hammer comprising a reciprocating percussion piston, ducts for supplying pressure fluid to the percussion hammer and for removing it therefrom, a main valve connected to be controlled by the position of the percussion piston so that it controls the flow of the pressure fluid to pressure surfaces of the percussion piston in order to provide a reciprocating motion, and a pressure control valve that is placed in the outlet duct and that is connected to the inlet duct for pressure fluid so that it opens the flow of pressure fluid from the percussion hammer to the outlet duct only when the pressure of the pressure fluid in the inlet duct exceeds a predetermined set value for pressure, the percussion hammer further comprising a separate by-pass duct via which the pressure fluid may flow during the return motion of the percussion piston from a pressure space situated above the percussion piston to the outlet duct to a certain point in the return motion of the percussion piston even when the pressure of the pressure fluid in the inlet duct is smaller than said set value of the pressure control valve.

2. A percussion hammer according to claim 1, wherein the by-pass duct is connected from a duct situated between the main valve and the pressure control valve to the cylinder space of the percussion piston so that when the percussion piston is in the lower position, the duct is connected via a groove provided in the percussion piston to the outlet duct, and that the percussion piston closes said connection during its return motion before the percussion piston is in its uppermost position.

3. A percussion hammer according to claim 1, wherein the by-pass duct comprises a throttle for adjusting the by-pass flow of pressure fluid to the desired level.

4. A percussion hammer according to claim 2, wherein the by-pass duct comprises a throttle for adjusting the by-pass flow of pressure fluid to the desired level.

5. A percussion hammer according to claim 1, wherein the by-pass duct is connected such that when the pressure of the pressure fluid in the inlet duct exceeds the set value of the pressure control valve, the pressure fluid can flow from the upper chamber of the percussion piston both directly via the pressure control valve and via the by-pass duct to the outlet duct before the percussion piston closes the connection from the by-pass duct to the outlet duct.

* * * * *